US009761951B2

(12) United States Patent
Kuonanoja

(10) Patent No.: US 9,761,951 B2
(45) Date of Patent: Sep. 12, 2017

(54) ADJUSTABLE ANTENNA APPARATUS AND METHODS

(75) Inventor: Reetta Kuonanoja, Oulu (FI)

(73) Assignee: PULSE FINLAND OY (FI)

( * ) Notice: Subject to any disclaimer, the term of this patent is extended or adjusted under 35 U.S.C. 154(b) by 1368 days.

(21) Appl. No.: 13/505,734

(22) PCT Filed: Oct. 20, 2010

(86) PCT No.: PCT/FI2010/050821

§ 371 (c)(1),
(2), (4) Date: Oct. 2, 2012

(87) PCT Pub. No.: WO2011/055003

PCT Pub. Date: May 12, 2011

(65) Prior Publication Data

US 2013/0038494 A1 Feb. 14, 2013

(30) Foreign Application Priority Data

Nov. 3, 2009 (FI) ..... 20096134

(51) Int. Cl.
*H01Q 1/38* (2006.01)
*H01Q 13/10* (2006.01)
(Continued)

(52) U.S. Cl.
CPC ..... *H01Q 9/42* (2013.01); *H01Q 1/243* (2013.01); *H01Q 5/364* (2015.01); *H01Q 5/378* (2015.01); *H01Q 9/145* (2013.01)

(58) Field of Classification Search
CPC ..... H01Q 13/10
(Continued)

(56) References Cited

U.S. PATENT DOCUMENTS 2,745,102 A 9/1956 Norgorden
3,938,161 A 2/1976 Sanford
(Continued)

FOREIGN PATENT DOCUMENTS

CN 1623250 A 6/2005
CN 16232550 6/2005
(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.
(Continued)

*Primary Examiner* — Graham Smith
(74) *Attorney, Agent, or Firm* — Gazdzinski & Associates, PC

(57) ABSTRACT

An adjustable monopole antenna apparatus and methods. In one embodiment, the antenna apparatus is intended for mobile terminals. In an exemplary implementation, there is an adjusting point is provided from which a conductor is branched to an adjusting circuit. The adjusting circuit comprises a switch and alternative reactive elements connected to ground, selectable by the switch. When a reactive element is changed, the electric length and resonance frequency of the radiator change, and the corresponding operating band shifts. If the antenna is configured as a dual-band antenna, the above-mentioned operating band is the lower band. One or more higher operating bands are based e.g. on radiating slots implemented by the same radiator conductor. The operating band of the exemplary embodiment of the antenna below the frequency 1 GHz can be shifted in a wider range than in the corresponding known antennas.

19 Claims, 3 Drawing Sheets

Figure 1:
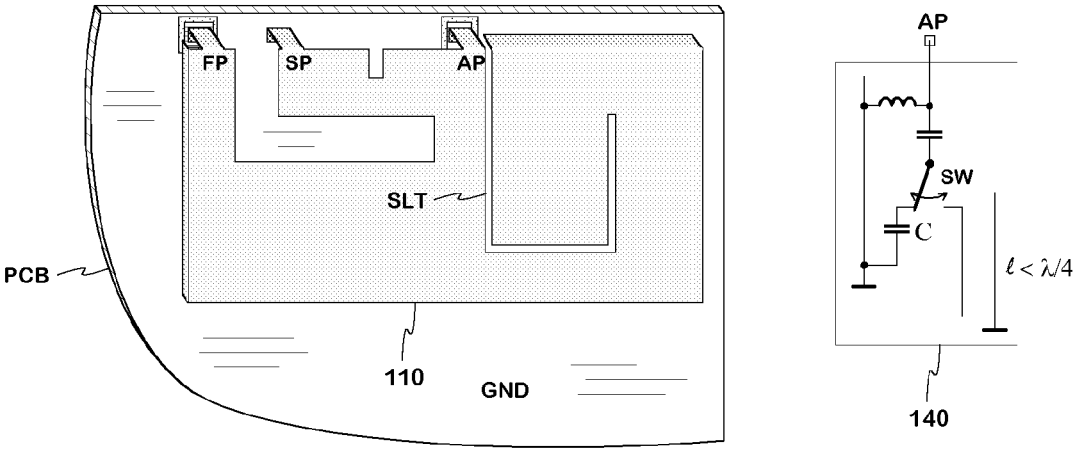
Fig. 1 PRIOR ART

(51) Int. Cl.

| | |
|---|---|
| ***H01Q 9/42*** | (2006.01) |
| ***H01Q 9/14*** | (2006.01) |
| ***H01Q 1/24*** | (2006.01) |
| ***H01Q 5/364*** | (2015.01) |
| ***H01Q 5/378*** | (2015.01) |

(58) Field of Classification Search
USPC ..... 343/746
See application file for complete search history.

(56) References Cited

U.S. PATENT DOCUMENTS

| | | | |
|---|---|---|---|
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |
| 4,123,758 | A | 10/1978 | Shibano et al. |
| 4,131,893 | A | 12/1978 | Munson et al. |
| 4,201,960 | A | 5/1980 | Skutta et al. |
| 4,255,729 | A | 3/1981 | Fukasawa et al. |
| 4,313,121 | A | 1/1982 | Campbell et al. |
| 4,356,492 | A | 10/1982 | Kaloi |
| 4,370,657 | A | 1/1983 | Kaloi |
| 4,423,396 | A | 12/1983 | Makimoto et al. |
| 4,431,977 | A | 2/1984 | Sokola et al. |
| 4,546,357 | A | 10/1985 | Laughon et al. |
| 4,559,508 | A | 12/1985 | Nishikawa et al. |
| 4,625,212 | A | 11/1986 | Oda et al. |
| 4,653,889 | A | 3/1987 | Bizouard et al. |
| 4,661,992 | A | 4/1987 | Garay et al. |
| 4,692,726 | A | 9/1987 | Green et al. |
| 4,703,291 | A | 10/1987 | Nishikawa et al. |
| 4,706,050 | A | 11/1987 | Andrews |
| 4,716,391 | A | 12/1987 | Moutrie et al. |
| 4,740,765 | A | 4/1988 | Ishikawa et al. |
| 4,742,562 | A | 5/1988 | Kommrusch |
| 4,761,624 | A | 8/1988 | Igarashi et al. |
| 4,800,348 | A | 1/1989 | Rosar et al. |
| 4,800,392 | A | 1/1989 | Garay et al. |
| 4,821,006 | A | 4/1989 | Ishikawa et al. |
| 4,823,098 | A | 4/1989 | DeMuro et al. |
| 4,827,266 | A | 5/1989 | Sato et al. |
| 4,829,274 | A | 5/1989 | Green et al. |
| 4,835,538 | A | 5/1989 | McKenna et al. |
| 4,835,541 | A | 5/1989 | Johnson et al. |
| 4,862,181 | A | 8/1989 | PonceDeLeon et al. |
| 4,879,533 | A | 11/1989 | De Muro et al. |
| 4,896,124 | A | 1/1990 | Schwent |
| 4,907,006 | A | 3/1990 | Nishikawa et al. |
| 4,954,796 | A | 9/1990 | Green et al. |
| 4,965,537 | A | 10/1990 | Kommrusch |
| 4,977,383 | A | 12/1990 | Niiranen |
| 4,980,694 | A | 12/1990 | Hines |
| 5,016,020 | A | 5/1991 | Simpson |
| 5,017,932 | A | 5/1991 | Ushiyama et al. |
| 5,043,738 | A | 8/1991 | Shapiro et al. |
| 5,047,739 | A | 9/1991 | Kuokkanene |
| 5,053,786 | A | 10/1991 | Silverman et al. |
| 5,057,847 | A | 10/1991 | Vaeisaenen |
| 5,061,939 | A | 10/1991 | Nakase |
| 5,097,236 | A | 3/1992 | Wakino et al. |
| 5,103,197 | A | 4/1992 | Turunen |
| 5,109,536 | A | 4/1992 | Kommrusch |
| 5,155,493 | A | 10/1992 | Thursby et al. |
| 5,157,363 | A | 10/1992 | Puurunen |
| 5,159,303 | A | 10/1992 | Flink |
| 5,166,697 | A | 11/1992 | Viladevall et al. |
| 5,170,173 | A | 12/1992 | Krenz et al. |
| 5,203,021 | A | 4/1993 | Repplinger et al. |
| 5,210,510 | A | 5/1993 | Karsikas |
| 5,210,542 | A | 5/1993 | Pett et al. |
| 5,220,335 | A | 6/1993 | Huang |
| 5,229,777 | A | 7/1993 | Doyle |
| 5,239,279 | A | 8/1993 | Turunen |
| 5,278,528 | A | 1/1994 | Turunen |
| 5,281,326 | A | 1/1994 | Galla |
| 5,298,873 | A | 3/1994 | Ala-Kojola |
| 5,302,924 | A | 4/1994 | Jantunen |
| 5,304,968 | A | 4/1994 | Ohtonen |
| 5,307,036 | A | 4/1994 | Turunen |
| 5,319,328 | A | 6/1994 | Turunen |
| 5,349,315 | A | 9/1994 | Ala-Kojola |
| 5,349,700 | A | 9/1994 | Parker |
| 5,351,023 | A | 9/1994 | Niiranen |
| 5,354,463 | A | 10/1994 | Turunen |
| 5,355,142 | A | 10/1994 | Marshall et al. |
| 5,357,262 | A | 10/1994 | Blaese |
| 5,363,114 | A | 11/1994 | Shoemaker |
| 5,369,782 | A | 11/1994 | Kawano et al. |
| 5,382,959 | A | 1/1995 | Pett et al. |
| 5,386,214 | A | 1/1995 | Sugawara |
| 5,387,886 | A | 2/1995 | Takalo |
| 5,394,162 | A | 2/1995 | Korovesis et al. |
| RE34,898 | E | 4/1995 | Turunen |
| 5,408,206 | A | 4/1995 | Turunen |
| 5,418,508 | A | 5/1995 | Puurunen |
| 5,432,489 | A | 7/1995 | Yrjola |
| 5,438,697 | A | 8/1995 | Fowler et al. |
| 5,440,315 | A | 8/1995 | Wright et al. |
| 5,442,280 | A | 8/1995 | Baudart |
| 5,442,366 | A | 8/1995 | Sanford |
| 5,444,453 | A | 8/1995 | Lalezari |
| 5,467,065 | A | 11/1995 | Turunen |
| 5,473,295 | A | 12/1995 | Turunen |
| 5,506,554 | A | 4/1996 | Ala-Kojola |
| 5,508,668 | A | 4/1996 | Prokkola |
| 5,510,802 | A | 4/1996 | Tsuru et al. |
| 5,517,683 | A | 5/1996 | Collett et al. |
| 5,521,561 | A | 5/1996 | Yrjola |
| 5,526,003 | A | 6/1996 | Ogawa et al. |
| 5,532,703 | A | 7/1996 | Stephens et al. |
| 5,541,560 | A | 7/1996 | Turunen |
| 5,541,617 | A | 7/1996 | Connolly et al. |
| 5,543,764 | A | 8/1996 | Turunen |
| 5,550,519 | A | 8/1996 | Korpela |
| 5,557,287 | A | 9/1996 | Pottala et al. |
| 5,557,292 | A | 9/1996 | Nygren et al. |
| 5,566,441 | A | 10/1996 | Marsh et al. |
| 5,570,071 | A | 10/1996 | Ervasti |
| 5,585,771 | A | 12/1996 | Ervasti |
| 5,585,810 | A | 12/1996 | Tsuru et al. |
| 5,589,844 | A | 12/1996 | Belcher et al. |
| 5,594,395 | A | 1/1997 | Niiranen |
| 5,604,471 | A | 2/1997 | Rattila |
| 5,627,502 | A | 5/1997 | Ervasti |
| 5,649,316 | A | 7/1997 | Prodhomme et al. |
| 5,668,561 | A | 9/1997 | Perrotta et al. |
| 5,675,301 | A | 10/1997 | Nappa |
| 5,689,221 | A | 11/1997 | Niiranen |
| 5,694,135 | A | 12/1997 | Dikun et al. |
| 5,696,517 | A | 12/1997 | Kawahata et al. |
| 5,703,600 | A | 12/1997 | Burrell et al. |
| 5,709,832 | A | 1/1998 | Hayes et al. |
| 5,711,014 | A | 1/1998 | Crowley et al. |
| 5,717,368 | A | 2/1998 | Niiranen |
| 5,731,749 | A | 3/1998 | Yrjola |
| 5,734,305 | A | 3/1998 | Ervasti |
| 5,734,350 | A | 3/1998 | Deming et al. |
| 5,734,351 | A | 3/1998 | Ojantakanen |
| 5,739,735 | A | 4/1998 | Pyykko |
| 5,742,259 | A | 4/1998 | Annamaa |
| 5,757,327 | A | 5/1998 | Yajima et al. |
| 5,760,746 | A | 6/1998 | Kawahata |
| 5,764,190 | A | 6/1998 | Murch et al. |
| 5,767,809 | A | 6/1998 | Chuang et al. |
| 5,768,217 | A | 6/1998 | Sonoda et al. |
| 5,777,581 | A | 7/1998 | Lilly et al. |
| 5,777,585 | A | 7/1998 | Tsuda et al. |
| 5,793,269 | A | 8/1998 | Ervasti |
| 5,797,084 | A | 8/1998 | Tsuru et al. |
| 5,812,094 | A | 9/1998 | Maldonado |
| 5,815,048 | A | 9/1998 | Ala-Kojola |

(56) References Cited

U.S. PATENT DOCUMENTS 5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Sekine et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,052,096 A 4/2000 Tsuru et al.
6,072,434 A 6/2000 Papatheodorou
6,078,231 A 6/2000 Pelkonen
6,091,363 A 7/2000 Komatsu et al.
6,091,365 A 7/2000 Derneryd et al.
6,097,345 A 8/2000 Walton
6,100,849 A 8/2000 Tsubaki et al.
6,112,106 A 8/2000 Crowley et al.
6,121,931 A 9/2000 Levi et al.
6,133,879 A 10/2000 Grangeat et al.
6,134,421 A 10/2000 Lee et al.
6,140,966 A 10/2000 Pankinaho
6,140,973 A 10/2000 Annamaa
6,147,650 A 11/2000 Kawahata et al.
6,157,819 A 12/2000 Vuokko
6,177,908 B1 1/2001 Kawahata
6,185,434 B1 2/2001 Hagstrom
6,190,942 B1 2/2001 Wilm et al.
6,195,049 B1 2/2001 Kim et al.
6,204,826 B1 3/2001 Rutkowski et al.
6,215,376 B1 4/2001 Hagstrom
6,246,368 B1 6/2001 Deming et al.
6,252,552 B1 6/2001 Tarvas et al.
6,252,554 B1 6/2001 Isohatala
6,255,994 B1 7/2001 Saito
6,268,831 B1 7/2001 Sanford
6,281,848 B1 8/2001 Nagumo et al.
6,295,029 B1 9/2001 Chen et al.
6,297,776 B1 10/2001 Pankinaho
6,304,220 B1 10/2001 Herve et al.
6,308,720 B1 10/2001 Modi
6,316,975 B1 11/2001 O'Toole et al.
6,323,811 B1 11/2001 Tsubaki
6,326,921 B1 12/2001 Egorov et al.
6,337,663 B1 1/2002 Chi-Minh
6,340,954 B1 1/2002 Annamaa et al.
6,342,859 B1 1/2002 Kurz et al.
6,343,208 B1 1/2002 Ying
6,346,914 B1 2/2002 Annamaa
6,348,892 B1 2/2002 Annamaa
6,353,443 B1 3/2002 Ying
6,366,243 B1 4/2002 Isohatala
6,377,827 B1 4/2002 Rydbeck
6,380,905 B1 4/2002 Annamaa
6,396,444 B1 5/2002 Goward
6,404,394 B1 6/2002 Hill
6,417,813 B1 7/2002 Durham et al.
6,421,014 B1 7/2002 Sanad
6,423,915 B1 7/2002 Winter
6,429,818 B1 8/2002 Johnson et al.
6,452,551 B1 9/2002 Chen
6,452,558 B1 9/2002 Saitou et al.
6,456,249 B1 9/2002 Johnson et al.
6,459,413 B1 10/2002 Tseng et al.
6,462,716 B1 10/2002 Kushihi
6,469,673 B2 10/2002 Kaiponen
6,473,056 B2 10/2002 Annamaa
6,476,767 B2 11/2002 Aoyama et al.
6,476,769 B1 11/2002 Lehtola
6,480,155 B1 11/2002 Eggleston
6,483,462 B2 11/2002 Weinberger
6,498,586 B2 12/2002 Pankinaho
6,501,425 B1 12/2002 Nagumo
6,515,625 B1 2/2003 Johnson
6,518,925 B1 2/2003 Annamaa
6,529,168 B2 3/2003 Mikkola
6,529,749 B1 3/2003 Hayes et al.
6,535,170 B2 3/2003 Sawamura et al.
6,538,604 B1 3/2003 Isohatala
6,538,607 B2 3/2003 Barna
6,542,050 B1 4/2003 Arai et al.
6,549,167 B1 4/2003 Yoon
6,552,686 B2 4/2003 Ollikainen et al.
6,556,812 B1 4/2003 Pennanen et al.
6,566,944 B1 5/2003 Pehlke
6,580,396 B2 6/2003 Lin
6,580,397 B2 6/2003 Lindell
6,600,449 B2 7/2003 Onaka
6,603,430 B1 8/2003 Hill et al.
6,606,016 B2 8/2003 Takamine et al.
6,611,235 B2 8/2003 Barna et al.
6,614,400 B2 9/2003 Egorov
6,614,401 B2 9/2003 Onaka et al.
6,614,405 B1 9/2003 Mikkonen
6,634,564 B2 10/2003 Kuramochi
6,636,181 B2 10/2003 Asano
6,639,564 B2 10/2003 Johnson
6,646,606 B2 11/2003 Mikkola
6,650,295 B2 11/2003 Ollikainen et al.
6,657,593 B2 12/2003 Nagumo et al.
6,657,595 B1 12/2003 Phillips et al.
6,670,926 B2 12/2003 Miyasaka
6,677,903 B2 1/2004 Wang
6,680,705 B2 1/2004 Tan et al.
6,683,573 B2 1/2004 Park
6,693,594 B2 2/2004 Pankinaho et al.
6,717,551 B1 4/2004 Desclos et al.
6,727,857 B2 4/2004 Mikkola
6,734,825 B1 5/2004 Guo et al.
6,734,826 B1 5/2004 Dai et al.
6,738,022 B2 5/2004 Klaavo et al.
6,741,214 B1 5/2004 Kadambi et al.
6,753,813 B2 6/2004 Kushihi
6,759,989 B2 7/2004 Tarvas et al.
6,765,536 B2 7/2004 Phillips et al.
6,774,853 B2 8/2004 Wong et al.
6,781,545 B2 8/2004 Sung
6,801,166 B2 10/2004 Mikkola
6,801,169 B1 10/2004 Chang et al.
6,806,835 B2 10/2004 Iwai
6,819,287 B2 11/2004 Sullivan et al.
6,819,293 B2 11/2004 De Graauw
6,825,818 B2 11/2004 Toncich
6,836,249 B2 12/2004 Kenoun et al.
6,847,329 B2 1/2005 Ikegaya et al.
6,856,293 B2 2/2005 Bordi
6,862,437 B1 3/2005 McNamara
6,862,441 B2 3/2005 Ella
6,873,291 B2 3/2005 Aoyama

(56) References Cited

U.S. PATENT DOCUMENTS

| | | | |
|---|---|---|---|
| 6,876,329 | B2 | 4/2005 | Milosavljevic |
| 6,882,317 | B2 | 4/2005 | Koskiniemi |
| 6,891,507 | B2 | 5/2005 | Kushihi et al. |
| 6,897,810 | B2 | 5/2005 | Dai et al. |
| 6,900,768 | B2 | 5/2005 | Iguchi et al. |
| 6,903,692 | B2 | 6/2005 | Kivekas |
| 6,911,945 | B2 | 6/2005 | Korva |
| 6,922,171 | B2 | 7/2005 | Annamaa |
| 6,925,689 | B2 | 8/2005 | Folkmar |
| 6,927,729 | B2 | 8/2005 | Legay |
| 6,937,196 | B2 | 8/2005 | Korva |
| 6,950,065 | B2 | 9/2005 | Ying et al. |
| 6,950,066 | B2 | 9/2005 | Hendler et al. |
| 6,950,068 | B2 | 9/2005 | Bordi |
| 6,950,072 | B2 | 9/2005 | Miyata et al. |
| 6,952,144 | B2 | 10/2005 | Javor |
| 6,952,187 | B2 | 10/2005 | Annamaa |
| 6,958,730 | B2 | 10/2005 | Nagumo et al. |
| 6,961,544 | B1 | 11/2005 | Hagstrom |
| 6,963,308 | B2 | 11/2005 | Korva |
| 6,963,310 | B2 | 11/2005 | Horita et al. |
| 6,967,618 | B2 | 11/2005 | Ojantakanen |
| 6,975,278 | B2 | 12/2005 | Song et al. |
| 6,980,158 | B2 | 12/2005 | Iguchi et al. |
| 6,985,108 | B2 | 1/2006 | Mikkola |
| 6,992,543 | B2 | 1/2006 | Luetzelschwab et al. |
| 6,995,710 | B2 | 2/2006 | Sugimoto et al. |
| 7,023,341 | B2 | 4/2006 | Stilp |
| 7,031,744 | B2 | 4/2006 | Kuriyama et al. |
| 7,034,752 | B2 | 4/2006 | Sekiguchi et al. |
| 7,042,403 | B2 | 5/2006 | Colburn et al. |
| 7,053,841 | B2 | 5/2006 | Ponce De Leon et al. |
| 7,054,671 | B2 | 5/2006 | Kaiponen et al. |
| 7,057,560 | B2 | 6/2006 | Erkocevic |
| 7,061,430 | B2 | 6/2006 | Zheng et al. |
| 7,081,857 | B2 | 7/2006 | Kinnunen et al. |
| 7,084,831 | B2 | 8/2006 | Takagi et al. |
| 7,099,690 | B2 | 8/2006 | Milosavljevic |
| 7,113,133 | B2 | 9/2006 | Chen et al. |
| 7,119,749 | B2 | 10/2006 | Miyata et al. |
| 7,126,546 | B2 | 10/2006 | Annamaa |
| 7,129,893 | B2 | 10/2006 | Otaka et al. |
| 7,129,894 | B1 | 10/2006 | Winter |
| 7,136,019 | B2 | 11/2006 | Mikkola |
| 7,136,020 | B2 | 11/2006 | Yamaki |
| 7,142,824 | B2 | 11/2006 | Kojima et al. |
| 7,148,847 | B2 | 12/2006 | Yuanzhu |
| 7,148,849 | B2 | 12/2006 | Lin |
| 7,148,851 | B2 | 12/2006 | Takaki et al. |
| 7,170,464 | B2 | 1/2007 | Tang et al. |
| 7,176,838 | B1 | 2/2007 | Kinezos |
| 7,180,455 | B2 | 2/2007 | Oh et al. |
| 7,193,574 | B2 | 3/2007 | Chiang et al. |
| 7,205,942 | B2 | 4/2007 | Wang et al. |
| 7,215,283 | B2 | 5/2007 | Boyle |
| 7,218,280 | B2 | 5/2007 | Annamaa |
| 7,218,282 | B2 | 5/2007 | Humpfer et al. |
| 7,224,313 | B2 | 5/2007 | McKinzie, III et al. |
| 7,230,574 | B2 | 6/2007 | Johnson |
| 7,233,775 | B2 | 6/2007 | De Graauw |
| 7,237,318 | B2 | 7/2007 | Annamaa |
| 7,256,743 | B2 | 8/2007 | Korva |
| 7,274,334 | B2 | 9/2007 | O'Riordan et al. |
| 7,283,097 | B2 | 10/2007 | Wen et al. |
| 7,289,064 | B2 | 10/2007 | Cheng |
| 7,292,200 | B2 | 11/2007 | Posluszny et al. |
| 7,319,432 | B2 | 1/2008 | Andersson |
| 7,330,153 | B2 | 2/2008 | Rentz |
| 7,333,067 | B2 | 2/2008 | Hung et al. |
| 7,339,528 | B2 | 3/2008 | Wang et al. |
| 7,340,286 | B2 | 3/2008 | Korva et al. |
| 7,345,634 | B2 | 3/2008 | Ozkar et al. |
| 7,352,326 | B2 | 4/2008 | Korva |
| 7,355,270 | B2 | 4/2008 | Hasebe et al. |
| 7,358,902 | B2 | 4/2008 | Erkocevic |
| 7,375,695 | B2 | 5/2008 | Ishizuka et al. |
| 7,381,774 | B2 | 6/2008 | Bish et al. |
| 7,382,319 | B2 | 6/2008 | Kawahata et al. |
| 7,385,556 | B2 | 6/2008 | Chung et al. |
| 7,388,543 | B2 | 6/2008 | Vance |
| 7,391,378 | B2 | 6/2008 | Mikkola |
| 7,405,702 | B2 | 7/2008 | Annamaa et al. |
| 7,417,588 | B2 | 8/2008 | Castany et al. |
| 7,423,592 | B2 | 9/2008 | Pros et al. |
| 7,432,860 | B2 | 10/2008 | Huynh |
| 7,439,929 | B2 | 10/2008 | Ozkar |
| 7,443,344 | B2 | 10/2008 | Boyle |
| 7,468,700 | B2 | 12/2008 | Milosavljevic |
| 7,468,709 | B2 | 12/2008 | Niemi |
| 7,498,990 | B2 | 3/2009 | Park et al. |
| 7,501,983 | B2 | 3/2009 | Mikkola |
| 7,502,598 | B2 | 3/2009 | Kronberger |
| 7,589,678 | B2 | 9/2009 | Perunka et al. |
| 7,616,158 | B2 | 11/2009 | Mark et al. |
| 7,633,449 | B2 | 12/2009 | Oh |
| 7,663,551 | B2 | 2/2010 | Nissinen |
| 7,679,565 | B2 | 3/2010 | Sorvala |
| 7,692,543 | B2 | 4/2010 | Copeland |
| 7,710,325 | B2 | 5/2010 | Cheng |
| 7,724,204 | B2 | 5/2010 | Annamaa |
| 7,760,146 | B2 | 7/2010 | Ollikainen |
| 7,764,245 | B2 | 7/2010 | Loyet |
| 7,786,938 | B2 | 8/2010 | Sorvala |
| 7,800,544 | B2 | 9/2010 | Thornell-Pers |
| 7,830,327 | B2 | 11/2010 | He |
| 7,843,397 | B2 | 11/2010 | Boyle |
| 7,889,139 | B2 | 2/2011 | Hobson et al. |
| 7,889,143 | B2 | 2/2011 | Milosavljevic |
| 7,901,617 | B2 | 3/2011 | Taylor |
| 7,903,035 | B2 | 3/2011 | Mikkola et al. |
| 7,916,086 | B2 | 3/2011 | Koskiniemi et al. |
| 7,963,347 | B2 | 6/2011 | Pabon |
| 7,973,720 | B2 | 7/2011 | Sorvala |
| 8,049,670 | B2 | 11/2011 | Jung et al. |
| 8,098,202 | B2 | 1/2012 | Annamaa et al. |
| 8,144,071 | B2 | 3/2012 | Thornell-Pers et al. |
| 8,179,322 | B2 | 5/2012 | Nissinen |
| 8,193,998 | B2 | 6/2012 | Puente et al. |
| 8,378,892 | B2 | 2/2013 | Sorvala |
| 8,466,756 | B2 | 6/2013 | Milosavljevic et al. |
| 8,473,017 | B2 | 6/2013 | Milosavljevic et al. |
| 8,564,485 | B2 | 10/2013 | Milosavljevic et al. |
| 8,629,813 | B2 | 1/2014 | Milosavljevic |
| 2001/0050636 | A1 | 12/2001 | Weinberger |
| 2002/0183013 | A1 | 12/2002 | Auckland et al. |
| 2002/0196192 | A1 | 12/2002 | Nagumo et al. |
| 2003/0146873 | A1 | 8/2003 | Blancho |
| 2004/0090378 | A1 | 5/2004 | Dai et al. |
| 2004/0137950 | A1 | 7/2004 | Bolin et al. |
| 2004/0145525 | A1 | 7/2004 | Annabi et al. |
| 2004/0171403 | A1 | 9/2004 | Mikkola |
| 2005/0057401 | A1 | 3/2005 | Yuanzhu |
| 2005/0159131 | A1 | 7/2005 | Shibagaki et al. |
| 2005/0176481 | A1 | 8/2005 | Jeong |
| 2006/0071857 | A1 | 4/2006 | Pelzer |
| 2006/0192723 | A1 | 8/2006 | Harada |
| 2007/0042615 | A1 | 2/2007 | Liao |
| 2007/0082789 | A1 | 4/2007 | Nissila |
| 2007/0139276 | A1 | 6/2007 | Svigelj et al. |
| 2007/0152881 | A1 | 7/2007 | Chan |
| 2007/0188388 | A1 | 8/2007 | Feng |
| 2008/0055164 | A1 | 3/2008 | Zhang et al. |
| 2008/0059106 | A1 | 3/2008 | Wight |
| 2008/0088511 | A1 | 4/2008 | Sorvala |
| 2008/0266199 | A1 | 10/2008 | Milosavljevic |
| 2009/0009415 | A1 | 1/2009 | Tanska |
| 2009/0135066 | A1 | 5/2009 | Raappana et al. |
| 2009/0174604 | A1 | 7/2009 | Keskitalo |
| 2009/0196160 | A1 | 8/2009 | Crombach |
| 2009/0197654 | A1 | 8/2009 | Teshima |
| 2009/0231213 | A1 | 9/2009 | Ishimiya |
| 2010/0220016 | A1 | 9/2010 | Nissinen |
| 2010/0244978 | A1 | 9/2010 | Milosavljevic |

(56) References Cited

U.S. PATENT DOCUMENTS

| | | | |
|---|---|---|---|
| 2010/0309092 | A1 | 12/2010 | Lambacka |
| 2011/0133994 | A1 | 6/2011 | Korva |
| 2012/0119955 | A1 | 5/2012 | Milosavljevic et al. |

FOREIGN PATENT DOCUMENTS

| | | | |
|---|---|---|---|
| CN | 1649205 | | 8/2005 |
| CN | 1316797 | | 10/2007 |
| CN | 101233651 | | 7/2008 |
| CN | 100418269 | | 9/2008 |
| CN | 101488772 | | 7/2009 |
| DE | 10104862 | | 8/2002 |
| DE | 10150149 | | 4/2003 |
| EP | 0 208 424 | | 1/1987 |
| EP | 0 376 643 | | 4/1990 |
| EP | 0 751 043 | | 4/1997 |
| EP | 0 807 988 | | 11/1997 |
| EP | 0 831 547 | | 3/1998 |
| EP | 0 851 530 | | 7/1998 |
| EP | 1 294 048 | | 1/1999 |
| EP | 1 014 487 | | 6/2000 |
| EP | 1 024 553 | | 8/2000 |
| EP | 1 067 627 | | 1/2001 |
| EP | 0 923 158 | | 9/2002 |
| EP | 1 329 980 | | 7/2003 |
| EP | 1 361 623 | | 11/2003 |
| EP | 1361623 | A1 | 11/2003 |
| EP | 1 406 345 | | 4/2004 |
| EP | 1 453 137 | | 9/2004 |
| EP | 1 220 456 | | 10/2004 |
| EP | 1 467 456 | | 10/2004 |
| EP | 1 753 079 | | 2/2007 |
| FI | 20020829 | | 11/2003 |
| FI | 118782 | | 3/2008 |
| FR | 2553584 | | 10/1983 |
| FR | 2724274 | | 3/1996 |
| FR | 2873247 | | 1/2006 |
| GB | 2266997 | | 11/1993 |
| GB | 2360422 | | 9/2001 |
| GB | 2389246 | | 12/2003 |
| JP | 59-202831 | | 11/1984 |
| JP | 60-206304 | | 10/1985 |
| JP | 61-245704 | | 11/1986 |
| JP | 06-152463 | | 5/1994 |
| JP | 07-131234 | | 5/1995 |
| JP | 07-221536 | | 8/1995 |
| JP | 07-249923 | | 9/1995 |
| JP | 07-307612 | | 11/1995 |
| JP | 08-216571 | | 8/1996 |
| JP | 09-083242 | | 3/1997 |
| JP | 09-260934 | | 10/1997 |
| JP | 09-307344 | | 11/1997 |
| JP | 10-028013 | | 1/1998 |
| JP | 10-107671 | | 4/1998 |
| JP | 10-173423 | | 6/1998 |
| JP | 10-209733 | | 8/1998 |
| JP | 10-224142 | | 8/1998 |
| JP | 10-322124 | | 12/1998 |
| JP | 10-327011 | | 12/1998 |
| JP | 11-004113 | | 1/1999 |
| JP | 11-004117 | | 1/1999 |
| JP | 11-068456 | | 3/1999 |
| JP | 11-127010 | | 5/1999 |
| JP | 11-127014 | | 5/1999 |
| JP | 11-136025 | | 5/1999 |
| JP | 11-355033 | | 12/1999 |
| JP | 2000-278028 | | 10/2000 |
| JP | 2001-053543 | | 2/2001 |
| JP | 2001-267833 | | 9/2001 |
| JP | 2001-217631 | | 10/2001 |
| JP | 2001-326513 | | 11/2001 |
| JP | 2002-319811 | | 10/2002 |
| JP | 2002-329541 | | 11/2002 |
| JP | 2002-335117 | | 11/2002 |
| JP | 2003-060417 | | 2/2003 |
| JP | 2003-124730 | | 4/2003 |
| JP | 2003-179426 | | 6/2003 |
| JP | 2004-112028 | | 4/2004 |
| JP | 2004-363859 | | 12/2004 |
| JP | 2005-005985 | | 1/2005 |
| JP | 2005-252661 | | 9/2005 |
| KR | 20010080521 | | 10/2001 |
| KR | 20020096016 | | 12/2002 |
| SE | 511900 | | 12/1999 |
| WO | WO 92/00635 | | 1/1992 |
| WO | WO 96/27219 | | 9/1996 |
| WO | WO 98/01919 | | 1/1998 |
| WO | WO 99/30479 | | 6/1999 |
| WO | WO 01/20718 | | 3/2001 |
| WO | WO 01/29927 | | 4/2001 |
| WO | WO 01/33665 | | 5/2001 |
| WO | WO 01/61781 | | 8/2001 |
| WO | WO 2004/017462 | | 2/2004 |
| WO | WO 2004/057697 | | 7/2004 |
| WO | WO 2004/100313 | | 11/2004 |
| WO | WO 2004/112189 | | 12/2004 |
| WO | WO 2005/062416 | | 7/2005 |
| WO | WO 2007/012697 | | 2/2007 |
| WO | WO-2007012697 | A1 | 2/2007 |
| WO | WO-2007042615 | A1 | 4/2007 |
| WO | WO-2009027579 | A1 | 3/2009 |
| WO | WO-2010105272 | A1 | 9/2010 |
| WO | WO 2010/122220 | | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

(56) References Cited

OTHER PUBLICATIONS

Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.
Hossa, R., A. Byndas, and M.E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12. 2005.APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh Rajender, "Broadband Planar Monopole Antennas," M Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*," Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, Sep. 2002 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.

ADJUSTABLE ANTENNA APPARATUS AND METHODS

PRIORITY AND RELATED APPLICATIONS

This application is a National Stage Application of, and claims priority to, under 35 U.S.C. 371, International Application No. PCT/FI2010/050821, filed Oct. 20, 2010, which claims the benefit of priority to Finnish Patent Application Serial No. 20096134 filed 3 Nov. 2009, the priority benefit of which is also herein claimed, each of the foregoing being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The invention relates generally to an antenna of a radio device, such as mobile wireless terminals, and particularly in one exemplary aspect to an adjustable monopole antenna.

2. Description of Related Technology

The adjustability of an antenna apparatus in this description that a resonance frequency or frequencies of the antenna can be changed electrically. The aim is that the operating band of the antenna around a resonance frequency always covers the frequency range, which the operation requires at each time. There are different causes for the need for adjustability. When a portable radio device such as a mobile terminal is very small-sized, the space available for the antenna of the device is correspondingly small, which results in that the antenna's bandwidths are relatively narrow. Then, as the terminal is intended to function in several systems having frequency ranges relatively close to each other, it is difficult or impossible to cover frequency ranges used by more than one radio system. Correspondingly, securing the function that conforms to specifications in both transmitting and receiving bands of a single system can become more difficult. If the system uses sub-band division, it is advantageous from the point of view of the radio connection quality if the resonance frequency of the antenna can be tuned in a sub-band being used at each time.

In a dual-band antenna said problem concerns particularly the lower operating band, which is then more difficult than the higher operating band to make wide enough. In practice, it has often to cover the frequency range, which is used by the systems GSM850 and GSM900 (Global System for Mobile telecommunications) together, that range being 824-960 MHz. Also devices, which function in so-called LTE system (Long Term Evolution) as well, are being introduced to the market. In the LTE standard bands have been specified in the frequency range 698-798 MHz, which widens the total range of the antenna's lower operating band to 698-960 MHz. However, no extra space, which would be very much needed, is available for the antenna. For these reasons this description concerns primarily the implementation of the lower operating band.

In the invention the adjustment of the antenna is carried out by means of a switch. The use of a switch for the aim in question is well known as such, as examples the solutions in FIGS. 1 and 2.

In FIG. 1 there is an arrangement, known from the publication WO 2007/012697, in which a switch is used for the shift of the antenna's operating bands. The antenna is of planar type, and it has been drawn as seen from above, or from the side of the radiating plane. The circuit board PCB of a radio device is seen below the radiating plane 110, the conductive upper surface of which board is signal ground GND and functions also as the ground plane of the antenna. The short-circuit conductor of the antenna joins the radiating plane at the short-circuit point SP, and the feed conductor at the feed point FP. In addition, a conductor of the antenna adjusting circuit 140 joins galvanically the radiating plane at the adjusting point AP. All three points are located at the same long side of the radiating plane, the short-circuit point being therebetween. The antenna has a lower and a higher operating band. The lower operating band is based on the resonator constituted by the whole radiating plane 110 and the ground plane, and the higher operating band is based on the slot radiator, the slot SLT of which starts from the edge of the radiating plane, beside the adjusting point AP.

The adjusting circuit 140 of the antenna is presented as a circuit diagram. The adjusting circuit comprises a multiple-way switch SW and reactive structural parts. The common terminal, or input, of the multiple-way switch is connected to the adjusting point AP of the radiating plane. The switch has two change-over terminals, or outputs, one of which is connected through a serial capacitor to a short transmission line short-circuited at its opposite end. The other output of the switch is connected to another short transmission line which is open at its opposite end. Changing the switch state changes the resonance frequencies of the antenna and thus the places of its operating bands. The adjusting circuit 140 is designed so that when the radiator is connected to the short-circuited transmission line, the whole adjusting circuit is 'seen' from the radiator as a very short short-circuited transmission line at the frequencies of the lower operating band. This means a low impedance. At the frequencies of the higher operating band the adjusting circuit is 'seen' as a short-circuited transmission line with the length about of quarter wave, which means a high impedance. When the radiator is connected to the open transmission line, the whole adjusting circuit is 'seen' from the radiator as a very short open transmission line at the frequencies of the lower operating band, which means a high impedance. At the frequencies of the higher operating band the adjusting circuit is 'seen' as an open transmission line with the length of about a quarter wave, which means a low impedance. The changes are caused, besides by the design of the adjusting circuit, also by the fact that the higher operating band is located at about double frequencies compared to the lower one.

The impedance changes result in that the lower operating band shifts downwards and the higher operating band upwards, when the switch output is changed from the short-circuited line to the open line. The lengths of the shifts are arranged by choosing the electric distance between the short-circuit point SP and adjusting point AP suitably. In the former state the lower operating band is intended to cover the frequency range 880-960 MHz of the EGSM system (Extended GSM) and the higher operating band the frequency range 1710-1880 MHz of the GSM1800 system. In the latter state of the switch the lower operating band is intended to cover the frequency range 824-894 MHz of the GSM850 system and the higher operating band the frequency range 1850-1990 MHz of the GSM1900 system. However, these aims will not be achieved, if the antenna's height may be e.g. 4 mm at the most due to lack of space. In this case the adjusting circuit has to be enlarged so that the lower operating band can at a time be set only at the transmitting or receiving band of the GSM850 system, for example. However, an unfavourable result is that the efficiency of the antenna structure degrades because of the increased switching losses.

In the solution of FIG. 1 the sufficient width of the higher operating band may require adding a parasitic element to the structure. In this case the total number of the contacts between the radiators and circuit board would be four, which means significant costs in the production.

Figure 2:
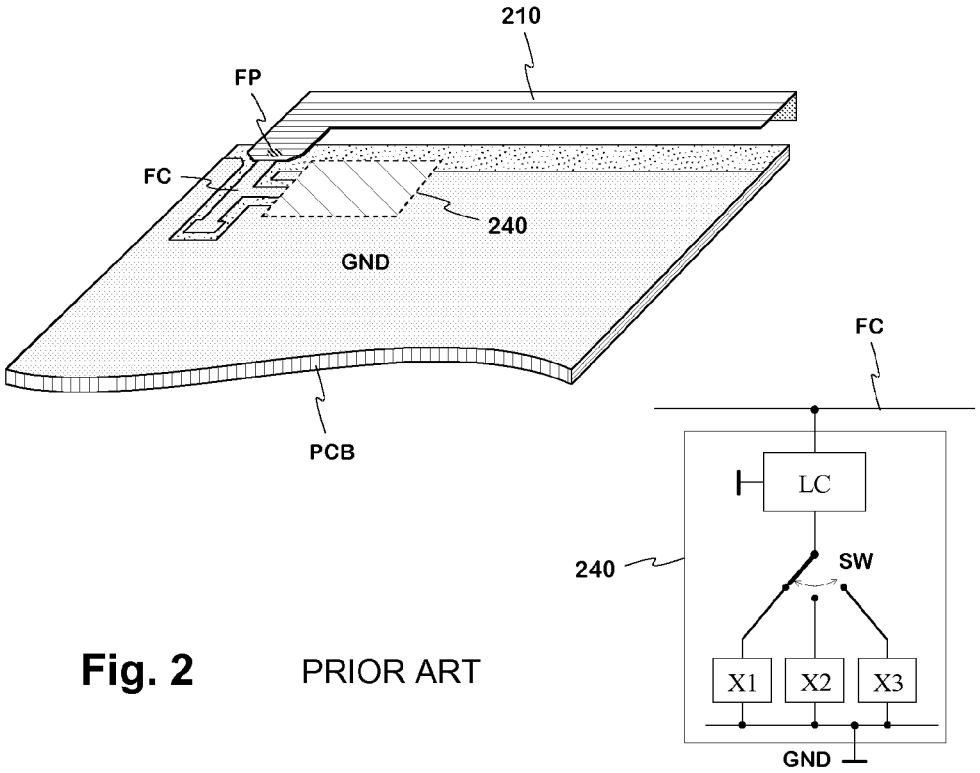
Fig. 2 PRIOR ART

FIG. 2 shows an arrangement including a switch, known from the publication WO 2007/042615. A portion of the circuit board PCB of a radio device is seen in the figure. The antenna is of ILA type (Inverted-L Antenna) and it has one band. Its monopole radiator 210 is a plate-like and rigid sheet metal strip, which has been connected to the antenna feed conductor FC at the feed point FP being located near a corner of the circuit board. The radiator is directed from that point first over the edge of the end of the circuit board outside the board and turns after that, still level with the upper surface of the circuit board, in the direction of the end. On the circuit board there is the signal ground GND, which functions as the antenna's ground plane, at a certain distance from the radiator 210. On the circuit board, at the end on the radiator side, there is the adjusting circuit 240 of the antenna. The adjusting circuit is marked on the circuit board as an area confined by a broken line and shown as a block diagram in the side drawing. From this drawing it appears that the adjusting circuit has been connected between the antenna feed conductor FC and the signal ground GND. The adjusting circuit comprises an LC circuit, a multiple-way switch SW and three alternative reactive structure parts X1, X2, X3. The LC circuit has been connected to the feed conductor at its one end and to the switch input at its other end. Its aim is to attenuate the harmonic frequency components being generated in the switch and to function as an ESD protector (Electrostatic Discharge) of the switch. The switch SW has three outputs, at a time to one of which the switch input can be connected. Each output of the switch has been fixedly connected to one of said reactive structure parts, the reactances of which exist against the signal ground. The interchanging of the reactance by controlling the switch changes the resonance frequency of the antenna and thus the place of its operating band. The operating band of the antenna has then three alternative places in this case.

A disadvantage of the solution in FIG. 2 is that good band characteristics and sufficient efficiency demand a remarkably long distance between the radiator and ground plane GND. This again means that the space requirement for the antenna still is, also in this case, stricter than desired. If it has to resign to a small space, the shift range of an operating band may remain too small.

In a first aspect of the invention, a small-sized adjustable antenna is disclosed. In one embodiment, the antenna is implemented as monopole type. In this exemplary implementation, about halfway along its radiator conductor, there is an adjusting point, from which a conductor is branched to the adjusting circuit of the antenna. The adjusting circuit comprises a switch and alternative reactive elements connected to the ground, selectable by the switch. When a reactive element is changed, the electric length and resonance frequency of the radiator change, in which case the corresponding operating band shifts. If the antenna is configured as a dual-band antenna, the above-mentioned operating band is the lower band. The higher operating band again is based e.g. on a radiating slot implemented by the same radiator conductor. A separate parasitic radiator may also be used in other variants.

One advantage of the exemplary embodiment of the invention is that the operating band of the antenna (e.g., below the frequency 1 GHz) can be shifted in a wider range than in the corresponding known antennas. This is due to the fact that the adjusting point of the antenna is located in the monopole radiator at a certain minimum distance from its feeding end. Another advantage of the invention is that the space required for the antenna inside the radio device is small.

In another aspect of the invention, an adjustable antenna is disclosed. In one embodiment, the antenna includes: a ground plane; a monopole type radiator with a feed point and first and second slots; an adjusting circuit configured to enable adjustment of at least one operating frequency of the antenna; and an adjusting point in communication with the radiator and the adjusting circuit. In one variant, the adjusting point is disposed substantially between the first and second slots.

In one variant, the antenna further includes a substantially rectangular dielectric support element having first and second distal ends, the feed point disposed towards the first distal end of the element, and the adjusting point disposed substantially central along a longitudinal axis of the dielectric element.

In another variant, the first and second slots are configured to each individually radiate and receive electromagnetic energy in a first frequency band, and the radiator is configured to radiate and receive electromagnetic energy in a second frequency band, the second band being lower in frequency than the first band.

In a further variant, the antenna further includes a parasitic radiator element, at least a portion of the parasitic element disposed proximate the feed point so as to induce substantial electromagnetic coupling there between.

In a second embodiment, the adjustable antenna includes a ground plane, a monopole type radiator with a feed point at its first end and an adjusting circuit with at least two reactive elements and a multi-way switch, by which one reactive element at a time can be connected to be a part of the adjusting circuit between an adjusting point of the antenna and the ground plane so as to set an operating band of the antenna to a desired value or range. In one variant, the adjusting point is located in the monopole type radiator at a distance l from a feed point measured along a middle line of a conductor of the radiator, l being a length of the middle line.

In another variant, the operating band is below a frequency of 1 GHz.

In another aspect of the invention, an antenna component is disclosed. In one embodiment, the component includes: a dielectric element having at least a first end and a second end; at least one monopole radiator element disposed on at least one surface of the dielectric element, the at least one radiator configured to implement a first operating band of the antenna; a feed point disposed towards the first end of the dielectric element; and an adjustment point disposed between the feed point and the second end of the dielectric element, the adjustment point being configured to enable shifting of at least one frequency band associated with the radiator element.

In another embodiment, the component includes a dielectric object and at least one monopole type radiator disposed on at least one surface thereof, the at least one radiator configured to implement a lower operating band of the antenna, a first end of the radiator comprising a feed point of the antenna. The component is further characterized in that the radiator comprises an adjusting point of the antenna, an intermediate conductor to be connected to an adjusting circuit of the antenna, the intermediate conductor branching from the adjusting point; and the distance of the adjusting point from the feed point is in the range of 0.1 l to 0.9 l measured along a middle line of the radiator, l being the total length of the middle line.

In a further aspect of the invention, a method of operating an adjustable antenna is disclosed. In one embodiment, the antenna includes a monopole radiator element having at least first and second portions, and an adjustment point disposed substantially at an intersection of the first and second portions, and the method includes altering a reactance in electrical communication with the adjustment point so as effect a shift of a frequency band of the monopole radiator element.

In one variant, the monopole radiator element further includes first and second portions with respective first and second slots, the first and second portions and respective slots configured to radiate within respective frequency bands which are each greater in frequency than the frequency band of the monopole radiator element, and the method further includes utilizing the first and second portions and respective slots to radiate within the respective frequency bands.

In another variant, the antenna further includes a parasitic radiator element disposed proximate at least a portion of the monopole radiator element, and the method further includes utilizing the parasitic element to radiate within a frequency band higher than the frequency band of the monopole radiator element.

In a further aspect of the invention, a method of configuring an adjustable antenna for a particular mobile device application is disclosed. In one embodiment, the antenna includes a monopole radiator having first and second portions formed on a dielectric element, and a feed point, and the method includes: selecting, based at least in part on the application: (i) a location of a frequency band adjustment point relative to the feed point and first and second portions; (ii) one or more reactances associated with an adjusting circuit electrically communicating with the adjustment point; and (iii) a configuration of a conductor coupling the adjusting circuit with the adjustment point.

In one variant, the method further includes selecting, based at least in part on the application, a location of the adjusting circuit relative to at least one of: the dielectric element; and/or the monopole radiator.

In a further variant, the conductor further comprises a circuit having at least one inductance, and the method further comprises selecting, based at least in part on the application, a value of the at least one inductance.

In yet another variant, the method further includes selecting, based at least in part on the application, a size and shape of the dielectric element, and thereby at least a portion of a configuration of the monopole radiator.

In another aspect of the invention, an adjusting circuit for use in an adjustable antenna is disclosed. In one embodiment, the circuit includes: a multiple position switching apparatus; a first conductor for electrically coupling the switching apparatus to an antenna radiating element through at least one first electrical component; a plurality of second conductors for electrically coupling respective ones of the multiple positions of the switching apparatus to ground through respective at least one second electrical components; and an inductance in communication with the first conductor.

In one variant, the at least one first electrical components and the at least one second electrical components each comprise blocking capacitors, and the adjusting circuit further includes at least one inductor in electrical series with at least one of the blocking capacitors in at least one of the second conductors between the switch apparatus and the ground.

In still another aspect of the invention, a wireless mobile device is disclosed. In one embodiment, the device includes: a housing comprising an interior cavity; a radio frequency transceiver; an adjustable antenna in signal communication with the transceiver; a first substrate disposed within the housing interior cavity and comprising a monopole antenna radiator disposed on at least one surface thereof; and a second substrate disposed within the housing interior cavity and having an adjusting circuit associated therewith, the adjusting circuit being in electrical communication with the antenna radiator.

In one variant, the first substrate is a substantially flexible substrate having the antenna radiator plated thereon, the flexible substrate being disposed proximate to at least one surface of the housing and conforming substantially thereto.

In another variant, the second substrate has the adjusting circuit mounted substantially thereon, the adjusting circuit being disposed in majority on a side of the second substrate that is not facing the first substrate.

In a further variant, the antenna radiator includes a first portion having a first slot formed therein, and a second portion having a second slot formed therein, and an adjusting contact region in communication with the adjusting circuit disposed at least partly between the first and second portions. The radiator element as whole is configured to operate in a first frequency band, whereas the first and second portions thereof are configured to operate in a second frequency band greater in frequency than the first band.

Figure 3:
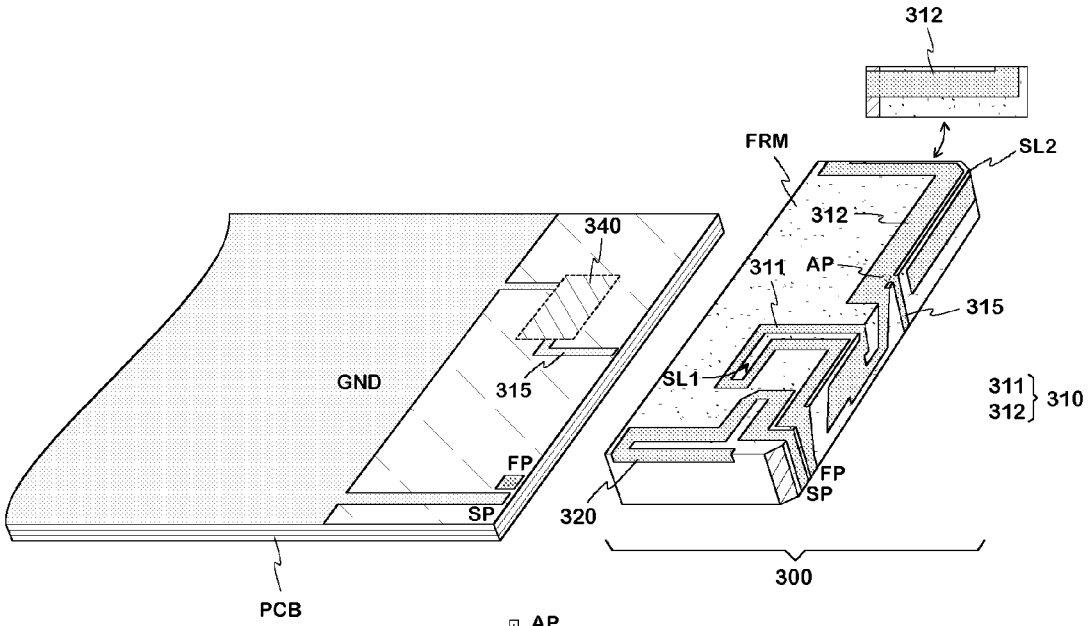
Figure 3:
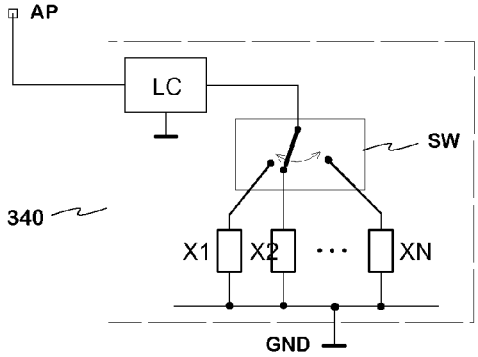
Figure 4:
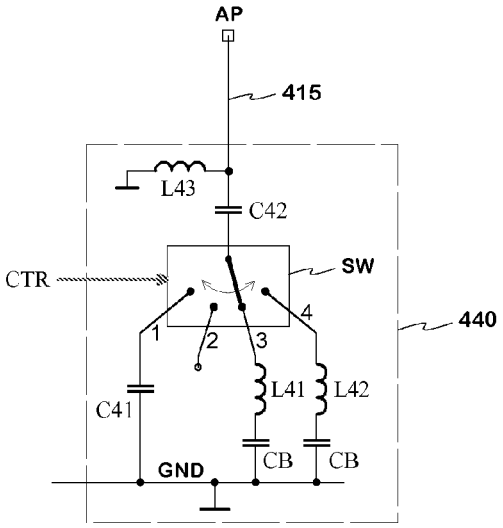
Figure 5:
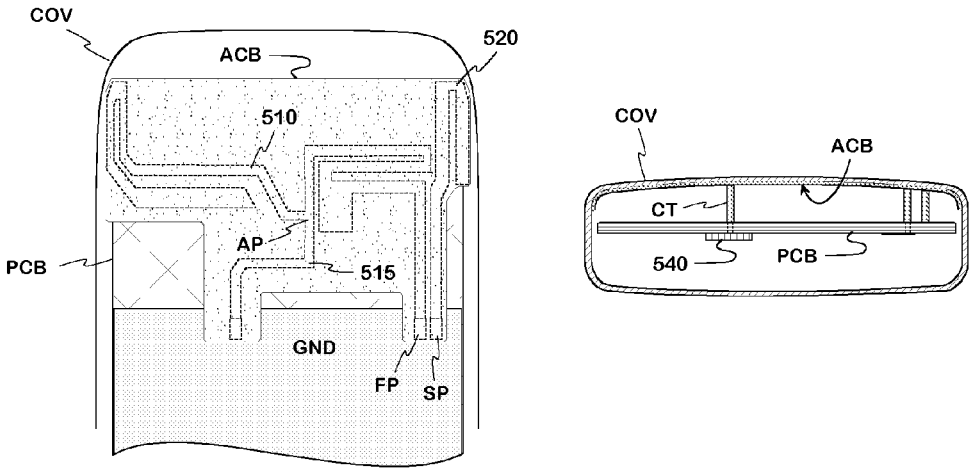
Figure 6:
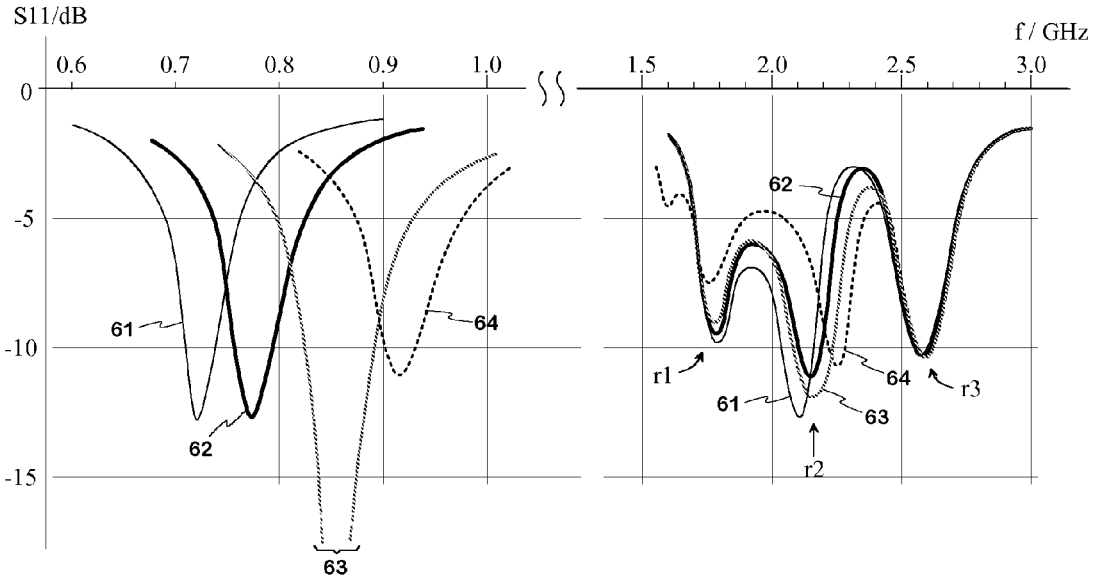

These and other features, objectives, and advantages of the invention will become more apparent from the detailed description set forth below when taken in conjunction with the drawings, wherein:

FIG. 1 presents an example of the adjustable antenna according to the prior art, FIG. 2 presents a second example of the adjustable antenna according to the prior art, FIG. 3 presents an example of the adjustable antenna according to the invention, FIG. 4 presents an example of the adjusting circuit of an antenna according to the invention, FIG. 5 presents a second example of the adjustable antenna according to the invention, and FIG. 6 presents an example of the band characteristics of an antenna according to the invention.

FIGS. 1 and 2 were already described in conjunction with the description of the prior art.

In FIG. 3 there is an example of the antenna according to the invention. The antenna is located at one end of the circuit board PCB of a radio device. The radiating conductors are of conductive coating of the dielectric antenna frame FRM, which is here a box with relatively thin walls. The frame FRM and the radiating conductors constitute an antenna component 300, which is attached on the surface of the circuit board, where the ground plane GND is located. In the figure the antenna component has been drawn apart from the circuit board for the sake of clarity.

In the example the antenna has two operating bands, the lower one of which is based on the resonance of the conductor of the monopole radiator 310. The feed point FP of the antenna is at one end of the monopole radiator 310, which end is here called the first end. An intermediate conductor 315 branches from the monopole radiator to the adjusting circuit 340 of the antenna. In this description and claims the branching point is called the adjusting point AP of the antenna. The adjusting circuit is located on the circuit board PCB in the inner space of the antenna frame FRM. A part of the intermediate conductor 315 is thus on the circuit board. The adjusting point divides the radiating conductor in question in two parts, the first part 311 between the first end and the adjusting point and the second part 312 between the adjusting point and the tail end.

The edge of the ground plane is aside the antenna component 300. Alternatively, the ground plane can extend at least to some extent under the antenna component.

The adjusting circuit 340 is in principle similar to the one in FIG. 2. Thus it comprises a multiple-way switch SW and a reactive element X1-XN between its each change-over terminal and the ground plane, or ground GND. The common terminal of the switch is connected to said adjusting point AP through an LC circuit, which functions as an ESD protector. Therefore, one reactive element at a time is a part of the circuit between the adjusting point and ground, depending on the state of the switch. Changing the reactive element by controlling the switch changes the antenna's resonance frequency, which correspond to the lower operating band, and thus the place of this operating band.

It is substantial in the invention that the adjusting point AP is not located right at the first end nor at the tail end of the radiating conductor. In FIG. 3 the adjusting point is located about halfway along the radiator conductor. More generally it can be said that the distance of the adjusting point from the feed point FP, measured along the middle line of the radiating conductor, is 0.1 l . . . 0.9 l, in which l is the length of this middle line. In this case the effect of the adjustment is made good, that is the shift range of the operating band is made wide enough. The optimal point naturally depends on the case, in other words, what kind of device the antenna is made for and what kind the structure itself is made. When designing the shifting steps of the operating band, the parameters are, besides the location of the adjusting point, the reactances of the reactive elements, the length and width of the intermediate conductor 315 and the place of the adjusting circuit. Also the inductance of the coil in said LC circuit can be utilized as a design parameter.

For implementing the higher operating band of the antenna the monopole radiator 310 has been shaped so that there are two slot radiators in it. The first part 311 of the monopole radiator rises from the feed point FP, which is near the first end of the antenna component 300, through the side surface of the frame FRM to its upper surface, makes there a pattern, returns back to the side surface and then again to the upper surface towards the adjusting point AP. A first slot SL1 with a U-shape remains between the successive portions of the first part. The second part 312 of the monopole radiator runs from the adjusting point along an edge of the upper surface of the frame to the second end of the antenna component, turns there to the direction of the head, continues then on the side of the head surface and further on said side surface next to its starting point, or the adjusting point AP. A second slot SL2 remains between the successive portions of the second part 312. The first and second slot are designed so that oscillation with different frequencies is excited in them, which both frequencies nevertheless are located in the range of the higher operating band. In accordance with the explanation afore, in the example of FIG. 3 the adjusting point AP is located between the radiator area, where the first slot SL1 is, and the area, where the second slot SL2 is.

The antenna shown in FIG. 3 includes also a parasitic element 320 which is a conductor strip at the first end of the antenna component. The parasitic element is connected to the ground plane GND from the short-circuit point SP which is located next to the feed point FP on the circuit board PCB. The starting end of the parasitic element and the starting end of the first part of the monopole radiator are close to each other so that there is a significant electromagnetic coupling between them. By a suitable design an oscillation can be excited in the parasitic element e.g. at a frequency in the higher operating band.

FIG. 4 shows an example of the adjusting circuit in the antenna according to the invention. The number of the alternative reactive elements in the adjusting circuit 440 is four. The first reactive element is a capacitor C41, which is then between the first change-over terminal of the multiple-way switch SW and the signal ground, or ground plane GND. Correspondingly, the second 'reactive element' is an open circuit, thus representing a very high reactance, the third reactive element is a coil L41 and the fourth reactive element is a coil L42. In series with these coils there are blocking capacitors CB to break the direct current circuit from the control of the switch. The capacitance of the blocking capacitors is so high, e.g. 100 pF, that they constitute almost a short-circuit at the antenna's use frequencies.

Between the common terminal of the switch SW and the intermediate conductor 415 leading to the adjusting point AP there is a capacitor C42, and between this capacitor's end on the side of the adjusting point and the ground plane there is a coil L43. The LC circuit C42-L43 functions as an ESD protector of the switch. In addition, the capacitor C42 functions as a blocking capacitor preventing the forming of a direct current circuit from the control of switch to the ground through the coil L43 or the radiator. The state of the switch is set by the control signal CTR.

FIG. 5 shows another example of the antenna according to the invention. The antenna comprises a monopole radiator 510, a parasitic element 520, an intermediate conductor 515, an adjusting circuit 540 and ground plane GND as in the example of FIG. 3. The intermediate conductor branches from the monopole radiator at the adjusting point AP, which is located relatively far from both the first and the tail end of the radiating conductor. In this case the monopole radiator, intermediate conductor and parasitic element are of conductive coating of a thin dielectric plate, and they all together constitute a flexible antenna circuit board ACB. The antenna circuit board is attached on the inner surface of the outer cover COV of a radio device, and it follows the cover's shape. The contact pads on the antenna circuit board are connected to the circuit board PCB of the radio device by contacts, like the contact CT functioning as a part of the intermediate conductor 515. In the example the adjusting circuit 540 is located on the opposite side of the circuit board PCB. The ground plane GND is a part of the conductive upper surface of the circuit board PCB.

FIG. 6 shows an example of the band characteristics of the antenna according to invention. The measured prototype is like the one in FIG. 3 and the adjusting circuit is like the one in FIG. 4. In the adjusting circuit the first reactive element C41=0.3 pF, the third reactive element L41=15 nH and the fourth reactive element L42=3.9 nH. Curve 61 shows the fluctuation of the reflection coefficient S11 of the antenna as a function of frequency, when the switch is in state 1, or its common terminal is connected to the first reactive element, curve 62 shows the fluctuation of the reflection coefficient, when the switch is in state 2, curve 63 shows the fluctuation of the reflection coefficient, when the switch is in state 3, and curve 64 shows the fluctuation of the reflection coefficient, when the switch is in state 4.

It is seen from the curves that the total shift of the lower operating band of the antenna is about 200 MHz and the total bandwidth is more than 280 MHz, if the value −5 dB of the reflection coefficient is regarded as criterion for the boundary frequencies of the band. By this criterion the lower operating band is about 690-760 MHz when the switch is in state 1, about 735-825 MHz when the switch is in state 2, about 800-894 MHz when the switch is in state 3 and about 875-975 MHz when the switch is in state 4. In switch's state 3 the operating band well covers the frequency range 824-894 MHz of the GSM850 system, and in state 4 it well covers the frequency range 890-960 MHz of the GSM900 system.

The higher operating band of the antenna in the example is very wide, about 1.7-2.7 GHz, from which the range 2.3-2.4 GHz is a bit poor. The higher operating band is based on three resonances: the resonance r1 of the parasitic element, the frequency of which is about 1.8 GHz, the resonance r2 of the second slot radiator formed by the monopole radiator, the frequency of which is about 2.2 GHz, and the resonance r3 of the first slot radiator, the frequency of which is about 2.6 GHz. The state of the switch in the adjusting circuit naturally affects a little also the higher operating band, but this effect is non-essential.

The adjustable antenna according to the invention has been described above. Naturally, its structure can in details vary from that presented. The shapes of the radiating elements of the antennas can vary widely. Also the implementation of the reactive elements in the adjusting circuit can vary. At least a part of them can be also short planar transmission lines on the surface of the circuit board. The invention does not limit the manufacturing method of the antenna. For example, said antenna frame can be a part of the outer cover of the radio device or the radiators can be on the surface of a chip type substrate. The inventive idea can be applied in different ways within the scope defined herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

The invention claimed is:

1. An adjustable antenna, comprising:

a ground plane;

a monopole type radiator with a feed point and first and second slots;

an adjusting circuit configured to enable adjustment of at least one operating frequency of the adjustable antenna;

an adjusting point in communication with the monopole type radiator and the adjusting circuit;

a short-circuit point disposed on the ground plane; and a feed point disposed between the short-circuit point and the adjusting point;

wherein the adjusting point is disposed substantially between the first and second slots.

2. The adjustable antenna of claim 1, further comprising a substantially rectangular dielectric support element having first and second distal ends, the feed point disposed towards the first distal end of the substantially rectangular dielectric support element, and the adjusting point disposed substantially central along a longitudinal axis of the substantially rectangular dielectric support element.

3. The adjustable antenna of claim 1, wherein the first and second slots are configured to each individually radiate and receive electromagnetic energy in a first frequency band, and the monopole type radiator is configured to radiate and receive electromagnetic energy in a second frequency band, the second frequency band being lower in frequency than the first frequency band.

4. The adjustable antenna of claim 3, further comprising a parasitic radiator element, at least a portion of the parasitic radiator element disposed proximate the feed point so as to induce substantial electromagnetic coupling therebetween.

5. The adjustable antenna of claim 4, wherein the parasitic radiator element is configured to operate substantially within the first frequency band.

6. The adjustable antenna of claim 1, further comprising a parasitic radiator element, at least a portion of the parasitic radiator element disposed proximate the feed point so as to induce substantial electromagnetic coupling therebetween.

7. The adjustable antenna of claim 1, further comprising a conductor connecting the adjusting point to the adjusting circuit, the conductor being configured to function as a reactance having a certain value, the certain value selected to optimize shifting of at least one operating band of the adjustable antenna.

8. The adjustable antenna of claim 1, wherein the adjusting circuit comprises:

at least two reactive elements; and a multi-way switch in switchable communication with the at least two reactive elements;

wherein the multi-way switch is configured to selectively place one of the at least two reactive elements in electrical communication with the adjusting point and the ground plane so as to set an operating band of the adjustable antenna to a desired value or range.

9. The adjustable antenna of claim 8, wherein the operating band is below a frequency of 1 GHz.

10. The adjustable antenna of claim 6, wherein the parasitic radiator element is configured to parasitically couple to at least a portion of the monopole type radiator so as to widen an operating frequency of the adjustable antenna.

11. The adjustable antenna of claim 1, wherein the first and second slots are configured to cause respective first and second portions of the monopole type radiator to radiate in an operating frequency.

12. The adjustable antenna of claim 11, wherein:

the first and second slots are configured to implement a higher operating band for the adjustable antenna; and the adjusting point is located substantially between an area of the monopole type radiator where the first slot is disposed and an area where the second slot is disposed.

13. The adjustable antenna of claim 1, wherein the adjusting point is located in the monopole type radiator at a distance/from the feed point measured along a middle line of a conductor of the monopole type radiator, the distance/being a length of the middle line.

14. The adjustable antenna of claim 1, wherein a distance of the adjusting point from the feed point is in the range of 0.1 l to 0.9 l measured along a middle line of the monopole type radiator, l being a total length of the middle line.

15. The adjustable antenna of claim 2, further comprising a parasitic element disposed on at least one surface of the substantially rectangular dielectric support element and configured to parasitically couple to at least a portion of the monopole radiator so as to widen an operating band of the adjustable antenna.

16. The adjustable antenna of claim 15, wherein the monopole type radiator is disposed on at least one surface of the substantially rectangular dielectric support element.

17. The adjustable antenna of claim 16, wherein the monopole type radiator is disposed on at least three surfaces of the substantially rectangular dielectric support element.

18. The adjustable antenna of claim 2, wherein the adjusting point is disposed between the feed point and the second distal end of the substantially rectangular dielectric support element.

19. The adjustable antenna of claim 1, further comprising an intermediate conductor configured to connect the adjusting point to the adjusting circuit and function as an inductance having a certain value selected to optimize shifts of the at least one operating frequency of the adjustable antenna.

* * * * *